United States Patent [19]

Williams

[11] 4,089,723

[45] May 16, 1978

[54] SIMULATED TEXTURED METAL AND METHOD OF PRODUCTION

[76] Inventor: Miriam D. Williams, 2 Racebrook Road, West Hartford, Conn. 06107

[21] Appl. No.: 659,224

[22] Filed: Feb. 19, 1976

[51] Int. Cl.[2] ..... B05D 5/00; B05D 1/36

[52] U.S. Cl. ..... 156/246; 156/249; 260/17.4 ST; 264/111; 427/201; 427/202; 427/205; 427/257; 428/147; 428/148; 428/152

[58] Field of Search ..... 427/204, 205, 262, 257, 427/202, 201; 428/143, 148, 152; 260/17.4 ST; 156/246, 249; 264/111

[56] References Cited

U.S. PATENT DOCUMENTS

| | | | |
|---|---|---|---|
| 2,021,152 | 11/1935 | Neuhaus | 428/148 |
| 2,041,297 | 5/1936 | Moore | 427/205 |
| 2,316,041 | 4/1943 | Armentrout | 427/287 X |
| 2,748,019 | 5/1956 | Schramm | 427/205 X |
| 2,823,190 | 2/1958 | Marcis | 428/152 |
| 3,232,818 | 2/1966 | Loew et al. | 428/148 X |
| 3,376,187 | 4/1968 | McKee et al. | 428/148 X |
| 3,620,899 | 11/1971 | Kelly et al. | 260/17.4 ST X |
| 3,853,797 | 12/1974 | Pelzig | 260/17.4 ST |
| 3,945,962 | 3/1976 | Clark | 260/17.4 ST X |
| 3,954,687 | 5/1976 | Wiest et al. | 260/17.4 ST X |

FOREIGN PATENT DOCUMENTS

| | | | |
|---|---|---|---|
| 691,428 | 7/1964 | Canada | 427/257 |

*Primary Examiner*—Michael F. Esposito
*Assistant Examiner*—Shrive P. Beck

[57] ABSTRACT

The appearance of simulated textured metal is imparted to a surface, which may comprise part of a design, by mixing a tinted aqueous solution of dextrin with a polyvinyl acetate emulsion to form a liquid base material. This base material is applied to the surface and thereafter a coating comprising a mixture of borax and a metal in powder form is distributed over the uncured base material. As the polyvinyl acetate dries a textured finish which simulates textured metal is obtained.

15 Claims, 2 Drawing Figures

SIMULATED TEXTURED METAL AND METHOD OF PRODUCTION

BACKGROUND OF THE INVENTION

1. Field of the Invention

The present invention relates to the formation, customarily on an initially smooth base, of articles characterized by a surface texture of pleasing appearance. More specifically, this invention is directed to simulated textured metal and articles embodying a simulated textured metal surface appearance. Accordingly, the general objects of the present invention are to provide novel and improved methods and articles of such character.

2. Description of the Prior Art

While not limited thereto in its utility, the present invention is particularly well suited for use as a craft activity wherein the constituent materials will be sold in kit form and the purchaser, employing the contents of the kit, may produce highly distinctive decorative items.

As a result of the generally considered pleasing aesthetic character of textured surfaces when compared to plain smooth surfaces, there have been numerous attempts in the prior art to finish materials in simulation of textured or hammered metal. Prior art attempts to provide a simulated textured metal finish have included such diverse techniques as embossing or selectively expanding a "blowable" form. The prior art has also contemplated the use of coatings which are either self-texturing or can be caused to assume a textured appearance as the result of further discontinuous treatment such as, for example, by splattering with a solvent. U.S. Pat. Nos. 2,326,001 and 2,724,704 are exemplary of the state of the art with respect to the producing of a simulated hammered metal finish on various substrates.

The prior art techniques for forming a simulated textured metal finish have been characterized by certain deficiencies which have precluded their general applicability. In order to be used by the general public in the home to produce decorative items, the constituent materials of a craft kit must be safe to handle and the processing steps required in the use of such materials must not require special equipment or create any potentially hazardous condition. Prior art techniques for the production of simulated textured metal finishes have involved the handling of hazardous materials and/or required processing steps such as heating in an oven. Thus, to summarize, there has not previously been available a technique for the production of a simulated textured metal finish which could be practiced in the home without the necessity of handling hazardous substances, such as acids, or the performance of procedures, such as heating, which required a special oven and/or encompassed the risk of release of toxic or explosive gases.

SUMMARY OF THE INVENTION

The present invention overcomes the above briefly discussed and other deficiencies and disadvantages of the prior art by providing a novel and improved technique for the production of simulated textured metal. In accordance with the present invention a solution of a linear glucose polymer, and particularly a pyrodextrin, is mixed with a coloring material to form a tinted aqueous solution of dextrin. The color selected in most cases will be black. The colored dextrin solution is mixed with a polyvinyl acetate emulsion, the PVA emulsion being characterized by minimum borax stability; i.e., borax incompatibility; to form a base material. If deemed necessary or desirable, ingredients may be added to the colored dextrin-polyvinyl acetate mixture to improve the shelf life thereof, to prevent spoilage and to keep the mixture from separating. Additives suitable for accomplishing these purposes include preservatives, such as metallic soap solutions, and plasticizers. Also, in certain cases it may be desirable to add a buffering agent to the polyvinyl acetate emulsion prior or subsequent to mixing the colored dextrin solution therewith. The thus prepared liquid base material may be stored for use at a later date.

When it is desired to prepare an article having a textured surface which simulates textured metal, the liquid dextrin-polyvinyl acetate mixture is employed to coat those portions of a substrate which define a design. A powder which can be sprinkled on the liquid dextrin-polyvinyl acetate mixture to cause surface irregularities to form will have been previously prepared. This powder will typically be separately packaged and may be sold with the liquid base material. The powder consists primarily of sodium borate dechydrate; this material being readily available and commonly called borax. The borax will, in most cases, be mixed with a metal in powder form. Additional coloring, in the form of dry artists pigment, may also be added as an ingredient of the powder.

The powder is sprinkled on the base; i.e., the design or portions of a design which have been covered with the liquid polyvinyl acetate-dextrin mixture; and as the polyvinyl acetate dries a textured finish which simulates textured metal is obtained. If the substrate has a release surface, the design may be removed therefrom subsequent to the formation of the desired surface texture but prior to complete curing. In such case the design will be self-adhesive and may be applied to any surface. Also, in the interest of forming an intricate design, spatially displaced portions thereof may be coated with the liquid base material and have the top powder applied in such a manner that two adjacent portions of the design do not present a liquid surface, partially textured or untextured, at the same time; i.e., the complete design is produced in stepwise fashion. Further, additional decorative items, such as simulated jewels or antique nail heads, may be embedded in the design. Completed designs, with or without additional decorative objects included therein, may be used without a supporting substrate as articles of jewelry, tree ornaments, etc.

BRIEF DESCRIPTION OF THE DRAWING

The present invention may be better understood and its numerous objects and advantages will become apparent to those skilled in the art by reference to the accompanying drawing wherein.

DESCRIPTION OF THE PREFERRED EMBODIMENT

Figure 1:
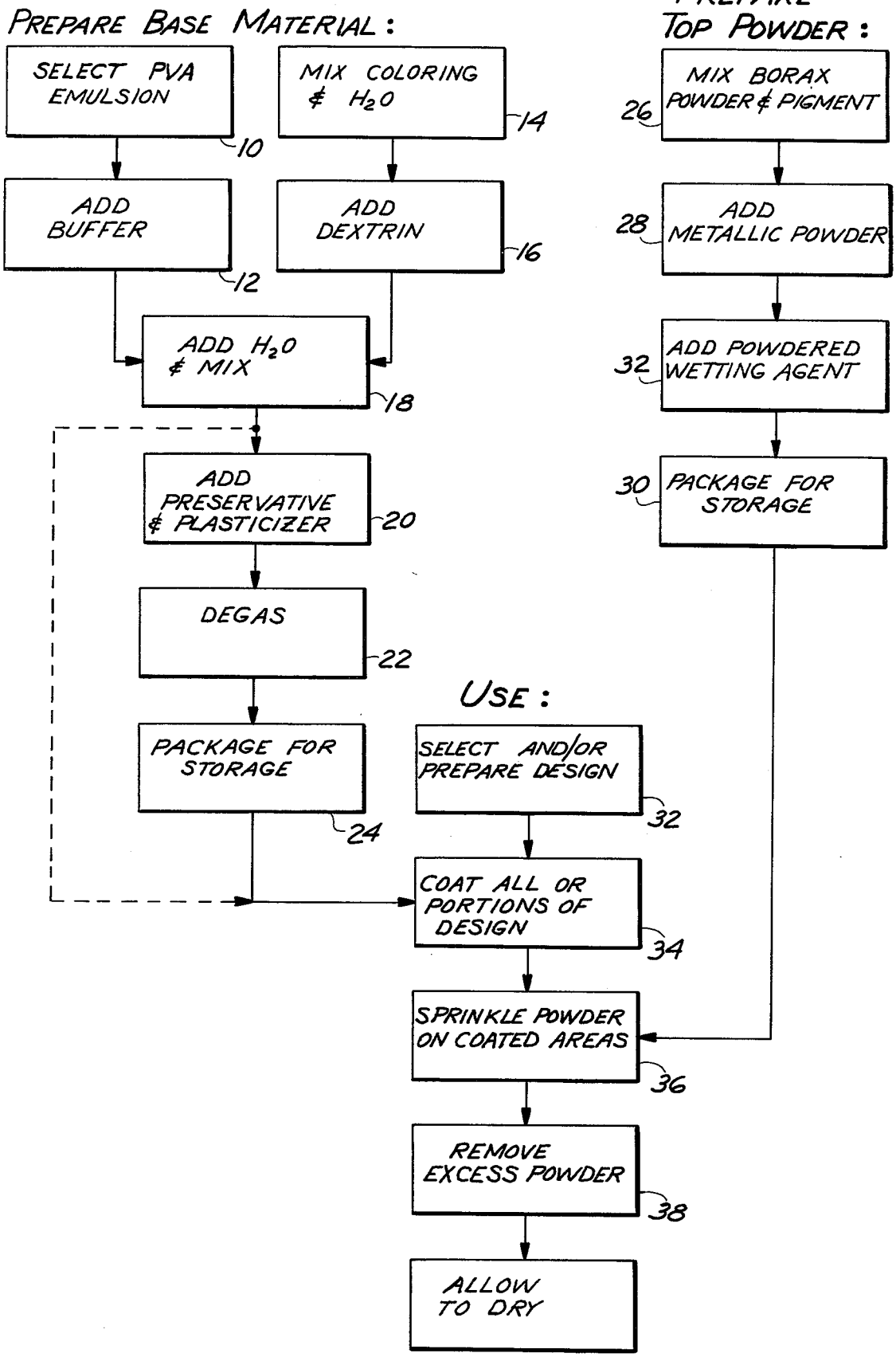
FIG. 1 is a flow chart depicting the practice of the present invention in accordance with a first embodiment thereof.

With reference now to the drawing, a first step in practice of the present invention consists of the selection of the polyvinyl acetate emulsion as indicated at 10 in FIG. 1. Particularly good results have been obtained employing an aqueous dispersion of polyvinyl acetate homopolymer with pH in the range of 3.5 – 5.5; the polyvinyl acetate having been formulated using polyvinyl alcohol as the emulsifying agent. Such a PVA emulsion is, for example, available from the Plastic Products and Resins Division of Monsanto Company, St. Louis, Mo. under the trademark GELVA emulsion S-77. It is essential that the polyvinyl acetate emulsion selected be characterized by coagulation in the presence of borax; i.e., that the PVA utilized have minimum borax stability.

It will, in most cases, be necessary or desirable to add a buffer to the PVA emulsion as indicated at step 12 in FIG. 1. Particularly good results have been achieved, where the GELVA S-77 was employed, by employing a mixture of equal parts of an aqueous solution of sodium acetate powder and 5% white vinegar as the buffering agent. The ratio of buffering agent to polyvinyl acetate emulsion will, of course, vary with the particular emulsion and buffering agent employed. The buffering agent serves to stabilize the pH of the PVA thus extending the shelf life of the base material of the present invention.

Since the polyvinyl acetate emulsion would ordinarily be clear when dry thus permitting the underlying surface to be seen therethrough, which would be undesirable for most decorative items, in most cases it is considered desirable to color the PVA. The formation of an aqueous solution for use in tinting the PVA emulsion is indicated at step 14. In accordance with the preferred embodiment of the present invention a concentrated non-ionic coloring material will be mixed with water. Where the PVA is to be tinted black, as is often the case, a product sold under the trade name X-2488 IMPerse Jet Black, available from the Imperial Color and Chemical Dept. of Hercules, Inc., Glen Falls, N.Y., may be employed. This coloring material is stated by the manufacturer to contain non-ionic dispersing agents and the colors are stable over a wide pH range and in the presence of cationic materials and heavy metals. The coloring material is usually mixed with water. The volume ratio of the concentrated coloring material to water will, of course, vary with the material selected but will typically be in the range of 1:10 to 1:20; a 1:15 ratio having been successfully employed with the X-2488 IMPerse Jet Black.

The next step in the fabrication of the base material of the present invention consists of the addition of a dextrin to the coloring solution. The dextrin is preferably a yellow pyrodextrin, although a white dextrin with the appropriate characteristics may be substituted therefor. Both white and yellow dextrins are conventionally prepared by heating a starch, typically a corn starch, in the presence of an acidic catalyst; hydrochloric and acetic acids being the usual catalysts and higher conversion temperatures being employed in the production of yellow dextrin. The yellow dextrins are characterized by higher water solubility than white dextrins. Suitable yellow dextrins for use in the practice of the present invention include type 8051 GLOBE Dextrin available from Corn Products Corporation, Argo, Ill., type NADEX 771 available from National Starch and Chemical Corporation of Bridgewater, N.J. and STADEX 125 available from A. E. Staley Manufacturing Company of Decatur, Illinois. The dextrin selected for use in the practice of this invention should have at least 95% minimum solubles, and preferably 98% minimum solubles, and 1:1 fluidity in the range of 6.0 to 9.5. As indicated at step 16 in FIG. 1, the dextrin is dissolved in the coloring mixture; the aqueous coloring solution preferably being at or above 65° F during the blending. Coloring solution temperatures of up to approximately 150° F have been successfully employed. The ratio by volume of dextrin to coloring mixture will vary slightly with the temperature of the aqueous tinting solution at the time of mixing and good results have been obtained with a ratio in the range of 1:1.125 to 1:1.1875.

The polyvinyl acetate emulsion is thereafter added, in step 18, to the liquid coloring-dissolved dextrin mixture to form a base material. The colored PVA-dextrin mixture produced in step 18 can, with or without inclusion of the buffering agent, be immediately used to produce decorative items in accordance with the present invention by coating on a substrate and sprinkling with a top powder in the manner to be described below. However, in most cases it will be desired to store the base material mixture for later use and, as indicated in steps 12 and 20, it is thus desirable to add ingredients to the mixture which will improve shelf-life, prevent spoilage and keep the mixture from separating. As indicated at step 20, a preservative and a plasticizer are usually added subsequent to formation of the tinted PVA-dextrin mixture. The preservative, which is believed to keep the molecules of dextrin in the base mixture separated, may comprise a solution of a metallic soap such as an aluminum stearate or hydrated alumina. The plasticizer may, for example, be hexylene glycol. The order in which the preservative and plasticizer are added will be determined by manufacturing efficiencies; the plasticizer usually being the last constituent to be added to the base material. The buffering agent may also be added in step 20 rather than in step 12. Thus, in one reduction to practice, water, the metallic soap in paste form, the sodium acetate-vinegar buffer and the hexylene glycol were serially added to the blended mixture of PVA and aqueous solution of dextrin and coloring material; the additional water being added to obtain the desired base material consistency. If the base material is to be packaged for storage it will typically be degassed, as indicated in step 22, prior to packaging in an air tight container as indicated in step 24.

Simultaneously with the preparation of the base material, in steps 10–24 as discussed above, a top powder will also be prepared and packaged. The top powder will principally comprise borax. As indicated at step 26, typically the borax is tinted by the addition thereto of a coloring material in the form of a ground dry artist's pigment. If the top powder is to be colored black, as is the usual case, the dry artist's pigment known as mars black may be employed.

A metallic powder is thereafter added to the tinted borax mixture as indicated at step 28. Excellent results have been obtained employing bronze (gold), copper and aluminum (silver) powders. Suitable metallic powders may be obtained from U.S. Bronze Powders, Inc. of Flemington, N.J. While a fine metallic powder will provide acceptable results, in the form of a smooth satin-like finish, as a general rule the brilliance of the low relief textured surfaces obtained through practice of the invention increases with the coarseness of the metallic powder employed.

The addition of the metallic powder to the tinted borax mixture will cusomarily complete the preparation of the top powder and the powder may thereafter be packaged, as indicated at step 30, for storage and later use. If deemed necessary or desirable a powdered wetting agent may be added to the top powder prior to packaging as indicated at step 32.

Figure 2:
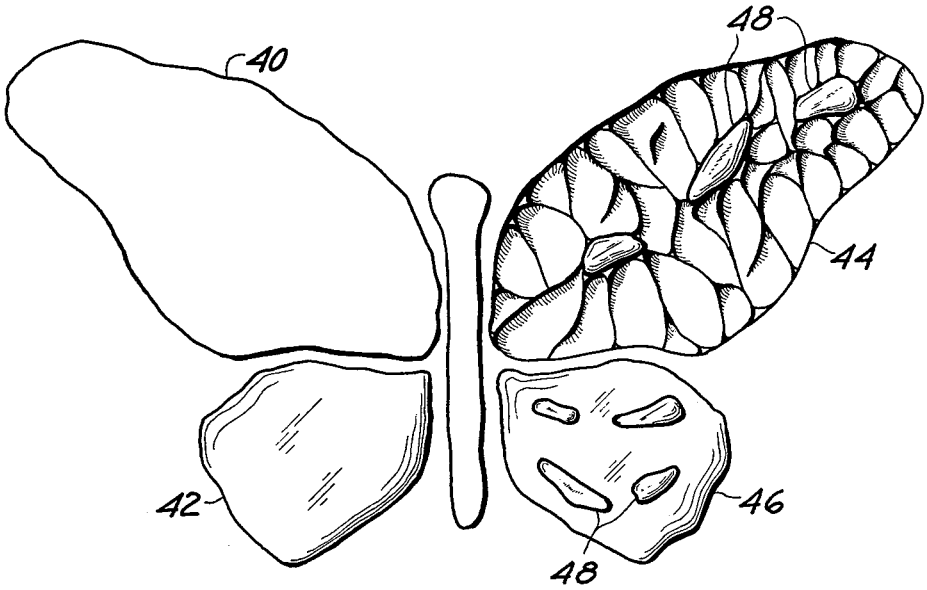
FIG. 2 depicts the practice of the invention with different portions of a design being shown in different stages of completion.

Referring now jointly to FIGS. 1 and 2, when it is desired to practice the present invention employing the base material and top powder prepared in the manner described above a permanent or temporary substrate is selected. If a temporary substrate is utilized it will typically have a release surface. The design to be produced will either have been previously outlined on or can, if the user has artistic talent, be sketched on the substrate. This initial step of substrate selection and/or preparation is indicated at 32 in FIG. 1. A butterfly design is shown, without the substrate being indicated, in FIG. 2. The next step, as indicated at 34, is to deposit the base material; i.e., the PVA-dextrin containing fluid on a first portion of or on all of the design. In FIG. 2 the portion of the design indicated at 40 is uncoated while the portion indicated at 42 has been coated with the base material. The preferable manner of use of the base material is to deposit droplets in the corners of the shape or portion of the design to be coated and to thereafter fill in the corners with the fluid using a pointed tool. Thereafter, the outline of the shape or design portion is completed by flowing the base material slowly on the inside of the line and, in so doing, connecting all the corners. Next, the outlined shape is filled in with the base material; the outlining base material containing the material subsequently deposited therein. It is usually desirable to employ a generous quantity of the base material since the amount or depth of the base material determines the depth of the textured metal effect which will be obtained.

After the shape or design portion is filled with the base material liquid, and except in areas of the design where a smooth finish having the color of the base material is desired, the base material is immediately and completely covered with the top powder; the top powder typically being applied by means of a shaker bottle. Any excess powder which falls outside of the region which has been covered with the base material will be removed by either brushing or wiping the material off the design. The top powder will adhere to the base material and will impart thereto the color of the metal in the powder. Almost immediately upon application of the top powder the base material will begin to wrinkle. This wrinkled effect may be seen in region 44 of the design of FIG. 2. When the drying has been completed a simulated textured metal finish will have resulted.

It is important to remove excess powder from the base material, as indicated in step 38, within 20 to 30 minutes subsequent to initial application of the powder. Failure to remove excess powder from the design areas may result in poor color and texture. Removal of excess powder from the partially cured base material will be accomplished with a brush.

If desired, decorative objects may be implanted in the base material. Such decorative items may be in the nature of irregularly shaped pieces of colored glass, imitation antique nail heads, etc. Transparent items such as pieces of glass will usually be adhesively secured to the substrate prior to deposition of the base material to avoid the tinted base material, which is usually black, from being visible therethrough. A design portion with glass pieces 48 embedded in the base material is indicated at 46 in FIG. 2 prior to application of the top powder. Items such as simulated nail heads or rivets will typically be embedded in the base material after the top powder has been applied but prior to complete hardening. Also, if desired, a unitary design; i.e., a design in which all of the parts are connected, may be lifted off a substrate having a release surface prior to complete curing and may be applied to and/or adhered to almost any surface; such a partially hardened design being self-adherent. A cured or partially cured design may also be removed from a release coated substrate and, when completely cured, used as an oranament or article of jewelry.

Specific examples of the practice of the present invention are as follows with all quantities being given in parts by volume:

EXAMPLE I

Base Material:

1⅓ parts of X-2488 IMPerse Jet Black non-ionic coloring material was mixed with 25 parts of water.

30 parts of yellow GLOBE dextrin type 8051 was added to the aqueous coloring material mixture (the coloring material being at room temperature). Mixing was continued until the dextrin was completely dissolved.

160 parts of GELVA S-77 polyvinyl acetate and 13⅓ parts of water were added to the coloring material-dextrin mixture.

The thus produced base material was suitable for immediate use.

Top Powder:

192 parts of borax was mixed with + 1 part Mars Black dry artist's pigment and 8 parts of metallic powder.

A design was thereafter coated with the PVA-dextrin-coloring material mixture and the top powder sprinkled thereon to produce a simulated metal.

EXAMPLE II

The top powder was identical to Example I.

The base material was identical to Example I with the exception that, in the interest of facilitating the dissolution of the dextrin in the coloring material, the dextrin was added with the temperature of the coloring material at approximately 150° F. The increase in temperature resulted in the requirement that additional dextrin be added to obtain the desired consistency. Thus, 31⅔ parts of dextrin were added to a mixture of 25 parts of water and 1⅓ parts of the non-ionic color concentrate.

EXAMPLE III

The top powder was mixed as in Example I.

The base material was mixed as in Example I but was intended to be stored for later use rather than being used immediately. Accordingly, after addition of the PVA to the dextrin-coloring material-water mixture, a plasticizer, buffer and preservative were added to the base material. Thus 1¾ parts of hexylene glycol, 1 part of an aqueous solution of sodium acetate powder mixed with an equal amount of 5% white vinegar and 6⅔ parts of aluminum stearate paste were added, one at a time, to the dextrin-PVA-coloring material-water mixture. The complete mixture was stirred very slowly after all ingredients were added and the resulting base material was allowed to stand for a sufficient period of time to permit evaporation of all bubbles resulting from the mixing.

EXAMPLE IV

Identical to Example III except that alumina hydrate paste was utilized as the preservative rather than aluminum stearate paste.

In Example III above, the aluminum stearate paste was produced by mixing, in a ratio of 1 to 60, a wetting agent with denatured alcohol. The wetting agent was American Cynamid OT 75% mixed with an equal amount of denatured alcohol. Thereafter, 628 parts of aluminum stearate powder were added. Finally, hot water was added slowly until a paste having the desired consistency was achieved. The amount of hot water was in the range of 48 to 72 parts by volume.

A hydrated alumina paste for use in Example IV was produced by adding 192 parts of light hydrated alumina to 72 parts of hot water. It may be desirable, but not mandatory, to add 12 parts of denatured alcohol to such a hydrated alumina paste. The desired consistency is achieved, if necessary, by adding additional hot water.

While preferred embodiments have been shown and described, various modifications and substitutions may be made to the present invention without departing from the spirit and scope thereof. Thus, it will be understood that the present invention has been described by way of illustration and not limitation.

What is claimed is:

1. A method for the production of a textured surface on at least a portion of a substrate comprising the steps of:

preparing an aqueous solution of dextrin;

mixing a polyvinyl acetate emulsion with the dextrin solution to form an acidic liquid base material, the polyvinyl acetate emulsion being characterized by borax incompatibility;

preparing an alkaline top powder by mixing borax and a metallic powder;

coating at least a portion of a substrate with the liquid base material;

dusting the liquid base material coating with the top powder;

removing any excess top powder from the base material prior to complete curing thereof; and permitting the coated base material to harden.

2. The method of claim 1 further comprising:

tinting the liquid base material.

3. The method of claim 2 wherein the step of tinting comprises:

forming a suitably colored aqueous dextrin solution prior to mixing with the polyvinyl acetate emulsion.

4. The method of claim 1 wherein the step of preparing the aqueous dextrin solution comprises:

mixing a coloring material with water; and adding a powdered dextrin having at least 95% solubles to the colored water solution to form a tinted aqueous solution of dextrin.

5. The method of claim 4 further comprising:

selecting a polyvinyl acetate emulsion for mixing with the aqueous dextrin solution, the polyvinyl acetate emulsion being characterized by minimum borax stability and employment of polyvinyl alcohol as an emulsifying agent.

6. The method of claim 5 further comprising the step of:

adding a buffering agent to the liquid base material.

7. The method of claim 5 further comprising the step of:

adding a preservative to the liquid base material.

8. The method of claim 5 further comprising the step of:

adding a plasticizer to the liquid base material.

9. The method of claim 6 wherein the step of adding a buffering agent comprises:

adding an aqueous solution of sodium acetate powder and vinegar to the aqueous solution of dextrin and a polyvinyl acetate emulsion.

10. The method of claim 7 wherein the step of adding a preservative comprises:

adding a metallic soap solution to the aqueous solution of dextrin and a polyvinyl acetate emulsion.

11. The method of claim 9 wherein the step of adding a plasticizer comprises:

adding hexylene glycol to the aqueous solution of dextrin and a polyvinyl acetate emulsion.

12. The method of claim 10 wherein the dextrin is a yellow pyrodextrin and said method further comprises:

adding a buffering agent to the liquid base material.

13. The method of claim 12 further comprising the step of:

adding a plasticizer to the liquid base material.

14. The method of claim 5 further comprising the step of:

embedding decorative objects in the liquid base material coating prior to dusting with the top powder.

15. The method of claim 5 wherein the substrate has a release surface and wherein said method further comprises:

removing the coated base material from the substrate subsequent to removal of excess top powder therefrom and prior to curing thereof and applying the thus removed and partially cured elements consisting of coated base material to a second substrate.

* * * * *